US006637349B1

(12) United States Patent
Lafferty

(10) Patent No.: US 6,637,349 B1
(45) Date of Patent: Oct. 28, 2003

(54) MOTORIZED PICNIC TABLE

(76) Inventor: Gregory A. Lafferty, 8923 8A Rd., Plymouth, IN (US) 46563

( * ) Notice: Subject to any disclaimer, the term of this patent is extended or adjusted under 35 U.S.C. 154(b) by 30 days.

(21) Appl. No.: 09/644,598

(22) Filed: Aug. 23, 2000

(51) Int. Cl.[7] ..... A47B 85/06

(52) U.S. Cl. ..... 108/20; 180/305; 280/30; 296/22

(58) Field of Search ..... 180/305; 230/30; 296/22, 163, 164; 108/20; 297/158.2, 158.3

(56) References Cited

U.S. PATENT DOCUMENTS

| | | | | | |
|---|---|---|---|---|---|
| 3,485,315 | A | | 12/1969 | Bergren | 180/306 |
| 3,741,606 | A | | 6/1973 | Grier | 296/22 |
| 3,880,458 | A | * | 4/1975 | Jackson | 296/164 |
| 3,940,175 | A | | 2/1976 | Robison | 296/22 |
| 4,040,658 | A | | 8/1977 | Mayol | 297/158.4 |
| 4,505,489 | A | | 3/1985 | Specie | 280/47.13 |
| 4,632,451 | A | * | 12/1986 | Lee | 108/137 |
| 4,787,541 | A | | 11/1988 | Pollard | |
| 4,824,163 | A | * | 4/1989 | Hendrych | 108/34 |
| 4,842,316 | A | | 6/1989 | Lerma et al. | 296/22 |
| 4,955,451 | A | | 9/1990 | Schaefer | 180/213 |
| 4,974,284 | A | | 12/1990 | Campbell | 16/29 |
| 5,031,563 | A | * | 7/1991 | Matre | 105/318 |
| 5,163,651 | A | | 11/1992 | Matsumoto | |
| 5,240,307 | A | | 8/1993 | Jones et al. | |
| 5,314,231 | A | | 5/1994 | Otterbacher | |
| 5,383,703 | A | | 1/1995 | Irvine, III | |
| 5,558,026 | A | * | 9/1996 | Seibert | 108/44 |
| 5,573,300 | A | | 11/1996 | Simmons | 296/197 |
| 5,640,949 | A | | 6/1997 | Smith | 126/276 |
| 5,730,066 | A | | 3/1998 | Auten et al. | |
| 5,833,251 | A | | 11/1998 | Peck | 280/87.01 |
| 5,855,038 | A | | 1/1999 | Dispense | |
| 5,921,623 | A | | 7/1999 | Nye et al. | |
| 5,937,764 | A | | 8/1999 | Olivier | |
| 6,010,185 | A | | 1/2000 | Petersen | |
| 6,082,269 | A | | 7/2000 | Padberg | 108/44 |
| 6,152,461 | A | | 11/2000 | Dunks | 280/30 |

* cited by examiner

*Primary Examiner*—Robert Olszewski
*Assistant Examiner*—James S. McClellan
(74) *Attorney, Agent, or Firm*—Baker & Daniels

(57) ABSTRACT

A motorized picnic table having a drive mechanism, wheels connected to and driven by the drive mechanism, a table mounted above the drive mechanism, and at least one seat adjacent the table. In the preferred embodiment, the seats are bench-type seats and flank the drive mechanism. The motorized table includes fenders covering at least a portion of the wheels to protect the feet and legs of picnickers using the table from the wheels when the table is in motion. A foot platform is provided for picnickers to rest their feet upon. The table has a roof and a roof mounting frame for mounting said roof above said table. The roof may be removable. The motorized table has open sides. The motorized table includes a steering mechanism wherein the steering mechanism can be operated by a picnicker seated on one of the seats. In the preferred embodiment, the steering mechanism extends through an aperture in the picnic table. The drive mechanism has a hydrostatic transmission. The operating control for the hydrostatic transmission may be provided with a biasing mechanism for biasing the control in a neutral position when not actively engaged by the operator.

24 Claims, 8 Drawing Sheets

MOTORIZED PICNIC TABLE

BACKGROUND OF THE INVENTION

1. Field of the Invention

This invention relates generally to a motorized table, and in particular, to a motorized picnic table having seats for transporting picnic goers and the table simultaneously to a desired picnic location or for picnicking while in transport.

2. Discussion of the Prior Art

Picnicking has long been a favorite family pastime and social activity. Popular picnic sites include the back yard, parks, and camping grounds. Of course, one of the main stays of any picnicking activity is the picnic table as the feast and conversation usually center therearound. There are times when some may opt for a grassy knoll and blanket for a romantic or nostalgic picnic; however, the utilization of picnic tables far exceeds these occasional blanket interludes, which are subject to uninvited insect participants and posterior soreness from hard ground.

From time to time, it becomes desirable to move the location of a picnic table to enhance the picnicking experience with family, friends or neighbors. For instance, it may be desired to move a picnic table into or out of the sun. Or, a particular grouping of tables may be desired. However, as most picnic tables are inherently bulky and are made of either wood, metal or a combination thereof, they are relatively heavy and not easily moved. As such, light weight portable picnic tables have been developed such as disclosed in U.S. Pat. Nos. 5,921,623 to Stephen Nye, et al; 5,314,231 to Gary Otterbacher; and 5,240,307 to Steven Jones, et al. The drawback to these folding tables is that the lightweight construction makes them less sturdy than a conventional picnic table. In addition, assembly can be cumbersome and time consuming, and the tables cannot be folded and transported with picnic items arranged on the table.

Attempts have also been made to mobilize conventional picnic tables such as disclosed in U.S. Pat. No. 5,855,038 to Joseph Dispense. Dispense discloses a conventional wooden picnic table having wheels being foldable down on one end of the picnic table such that the picnic table can be picked up by the other end and rolled on the wheels. The problem with the table disclosed in Dispense is that the operator may be injured from lifting an end of a heavy table or when moving it. Furthemore, movement over long distances or rough terrain is impractical and cumbersome. As such, it would be desirable to have a picnic table having the sturdy construction of a conventional table and yet capable of being easily and conveniently moved from one location to another. It would also be desirable, for convenience, if the table could be moved with picnic items located on the picnic table surface.

In addition, it would be desirable to provide a picnic table that is easily movable with picnickers seated at the table. Such a table would greatly enhance the picnicking experience by providing a fun way to increase socialization with other picnickers. Furthermore, it would provide the ability to quickly change the picnic surroundings.

SUMMARY OF THE INVENTION

It is a feature of the invention to provide a motorized picnic table having a drive mechanism, wheels connected to and driven by the drive mechanism, a table mounted above the drive mechanism, and at least one seat adjacent the table. In the preferred embodiment, the seats are bench-type seats and flank the drive mechanism.

It is also a feature of the invention that the motorized table includes fenders covering at least a portion of the wheels to protect the feet and legs of picnickers using the table from the wheels when the table is in motion. The invention also includes a foot platform for picnickers to rest their feet upon.

Another feature of the invention is that the table has a roof and a roof mounting frame for mounting said roof above said table. The roof may be removable.

It is a further feature of the invention that the motorized table has open sides.

Yet another feature of the invention is that the motorized table includes a steering mechanism wherein the steering mechanism can be operated by a picnicker seated on one of the seats. In the preferred embodiment, the steering mechanism extends through an aperture in the picnic table.

Also, a feature of the invention is that the drive mechanism includes a hydrostatic transmission. The operating control for the hydrostatic transmission may be provided with a biasing mechanism for biasing the control in a neutral position when not actively engaged by the operator.

DETAILED DESCRIPTION OF THE PREFERRED EMBODIMENT

Figure 1:
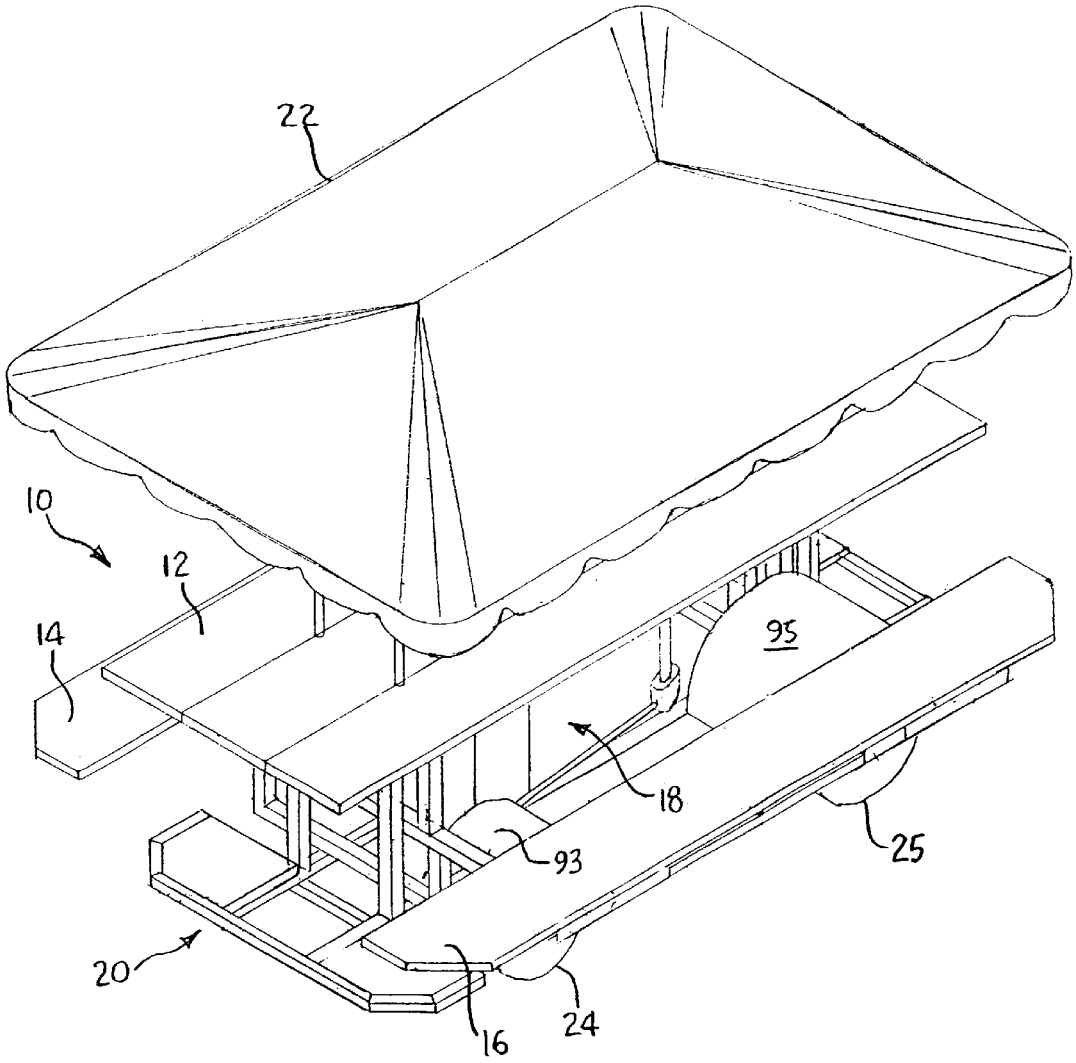
FIG. 1 is a perspective view of a motorized picnic table in accordance with he present invention.
Figure 2:
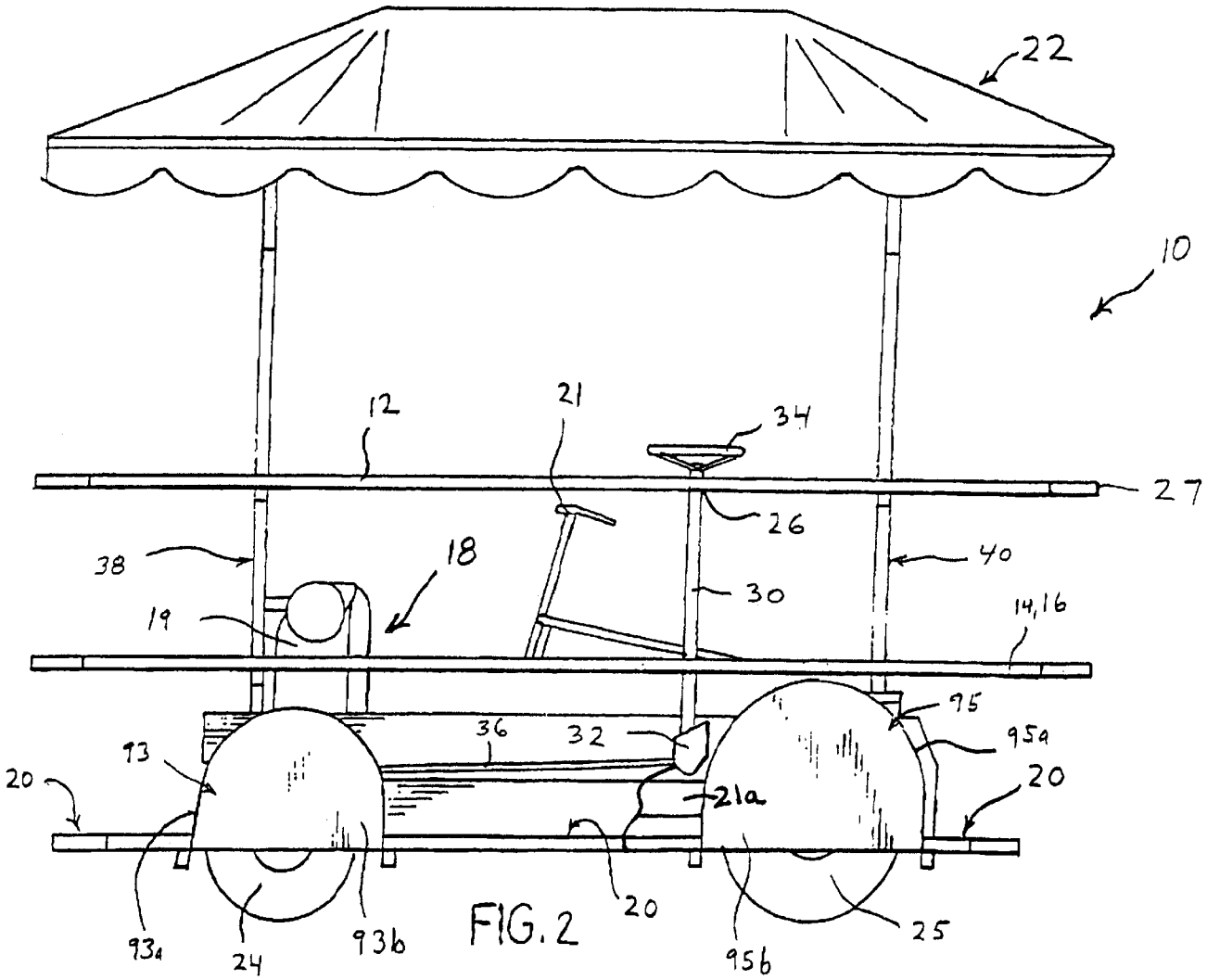
FIG. 2 is a side view of the motorized picnic table.
Figure 3:
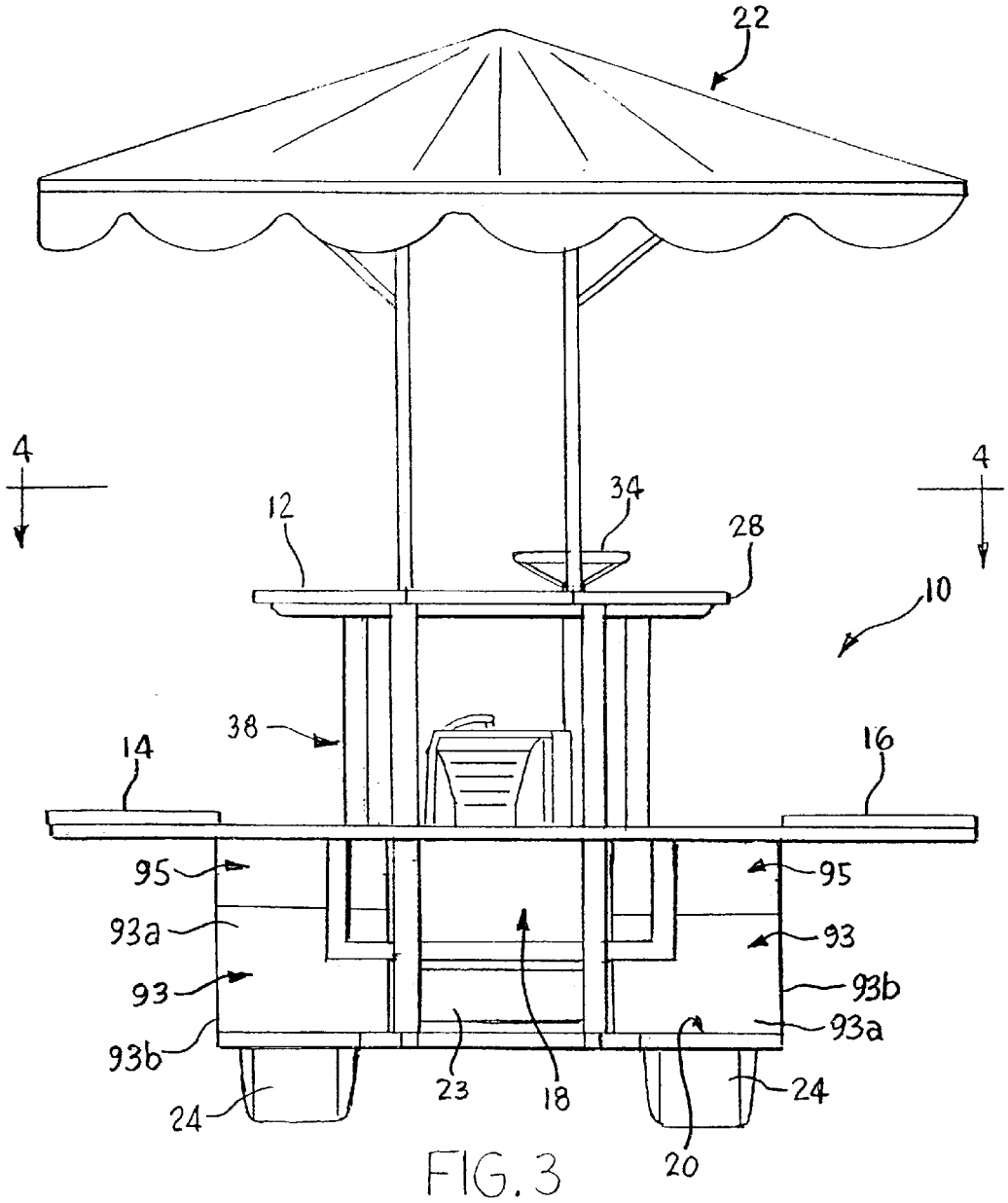
FIG. 3 is a front view of the motorized picnic table.

A picnic table having motorized propulsion is shown generally at 10 in FIGS. 1–3. Motorized picnic table 10 includes a picnic table top 12 a pair of bench-type seats 14, 16 and a drive mechanism generally indicated as 18. Motorized picnic table 10 also includes flooring or a foot platform generally indicated at 20 and a removable canopy generally indicated as 22.

In the preferred embodiment, drive mechanism 18 utilizes a chassis from a Cub Cadet tractor, Model #129 from the year 1972. The chassis includes a Kohler 12 horsepower four stroke gasoline engine 19; a variable speed, reversing, hydrostatic transmission shown generally as 21*a* with a control lever 21; drive train (not shown); chassis frame 23; wheels 24, 25; and axles (not shown). The tractor chassis is used primarily as manufactured and assembled by Cub Cadet. The chassis frame 23 consists of two parallel steel C channels, which are 54 inch long and 8 inch in height. The parallel channels are separated by 12 inch and supported by two twelve inch long internally-welded supports. The forward axle (not shown) of the Cub Cadet, Model 129 has two spindles (not shown) which support the front wheels 24 through two bronze journaled bushings (not shown). The transaxle assembly (not shown) contains a rear axle housing (not shown), which supports rear wheels 25. The engine 19 and transmission are connected directly by a drive shaft (not shown). The transaxle assembly contains the hydrostatic transmission and differential gears to power the rear wheels 25. Additionally, the transaxle provides lockable mechanical brakes (not shown) for the rear wheels 25, again, as standard on the Cub Cadet, Model 129.

Figure 4:
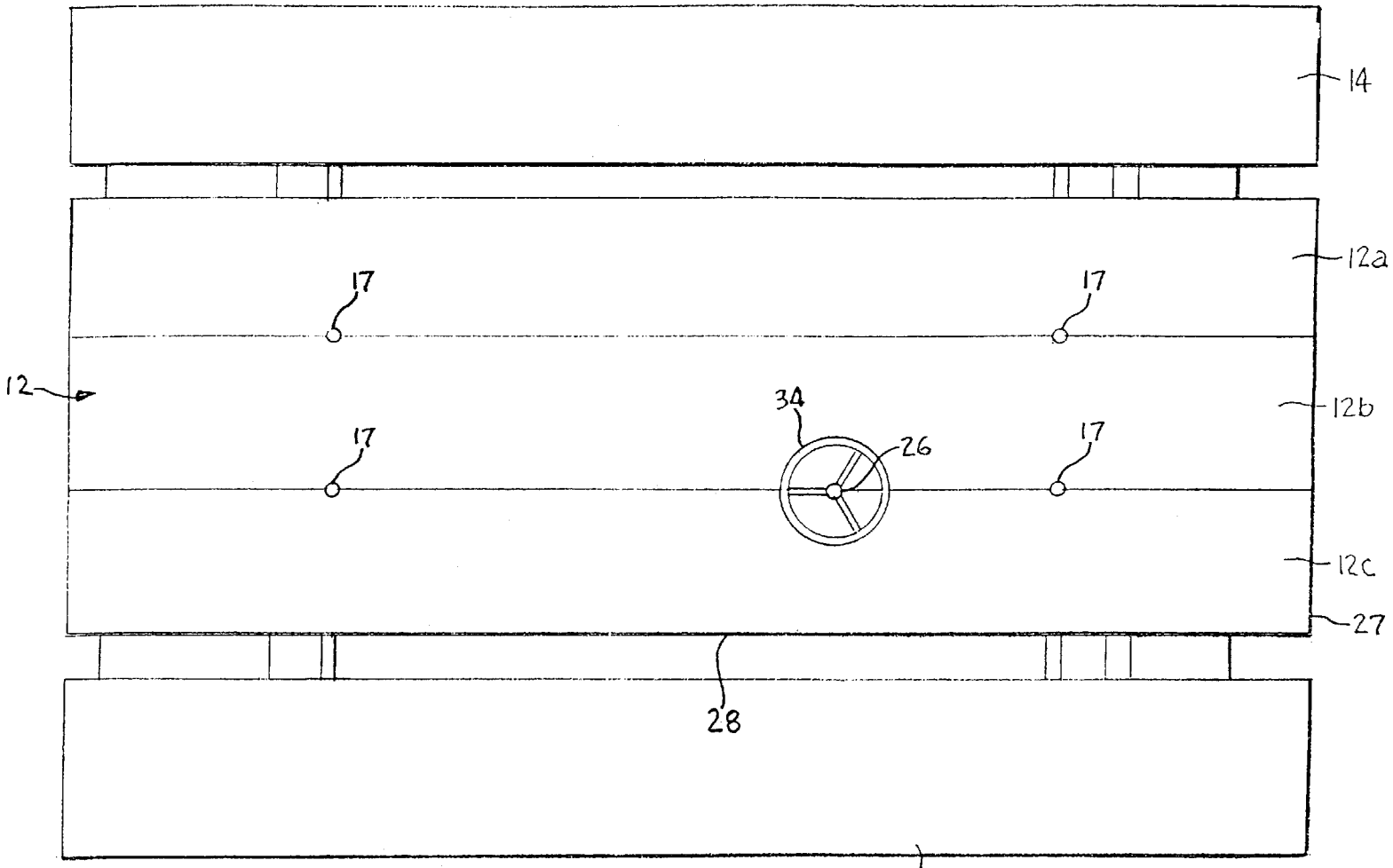
FIG. 4 is a top view of the motorized picnic table taken along lines 4—4 of FIG. 3.

In the preferred embodiment, table top 12 is constructed of three 1.5 inch thick by 11.5 inch wide (2×12) southern yellow pine (SYP) Planks 12*a*, 12*b*, and 12*c* as shown in FIG. 4. Each plank is ninety-six inches long and they are secured in a side by side relationship. Like table top planks 12*a–c*, bench seats 14–16 are also constructed from 2×12 SYP and are ninety-six inches long.

In addition to mounting bolt holes (not shown), table top 12 has five apertures. Four canopy mounting apertures 17 are provided and a steering aperture 26 is located at a distance of approximately ⅓ the length of the table top from rear table top edge 27, and also approximately ⅓ the width of table top 12 from a side edge 28 which is adjacent seat 16. As best shown in FIG. 2, a steering rod 30 extends through steering aperture 26 from a steering gear box 32 to a steering wheel 34. It has been found that this location for steering wheel 34 provides a convenient place for an operator to drive motorized picnic table 10 while seated on seat 16. Steering gear box 32 is the standard steering box, which accompanies the Cub Cadet, Model 129 and is a worm and sector gear type steering gear box that is attached to the chassis frame 23. Gear box 32 is connected by a 0.5 inch diameter steel turning rod 36 to the standard steering linkage (not shown) at the left front wheel spindle of the Cub Cadet, Model 129. Turning rod is thirty-six inches long, which is longer than the standard turning rod that comes with the Cub Cadet, Model 129 since the steering wheel 34 has been placed farther back in the vehicle than when factory installed. A 0.5 inch diameter tie rod (not shown) as is standard on the Cub Cadet, Model 129 connects the left front wheel spindle to the right front wheel spindle. The turning rod 36 and tie rod both utilize heavy duty 0.4375 inch diameter swiveling tie rod ends (not shown) at each end of the rods.

Figure 7:
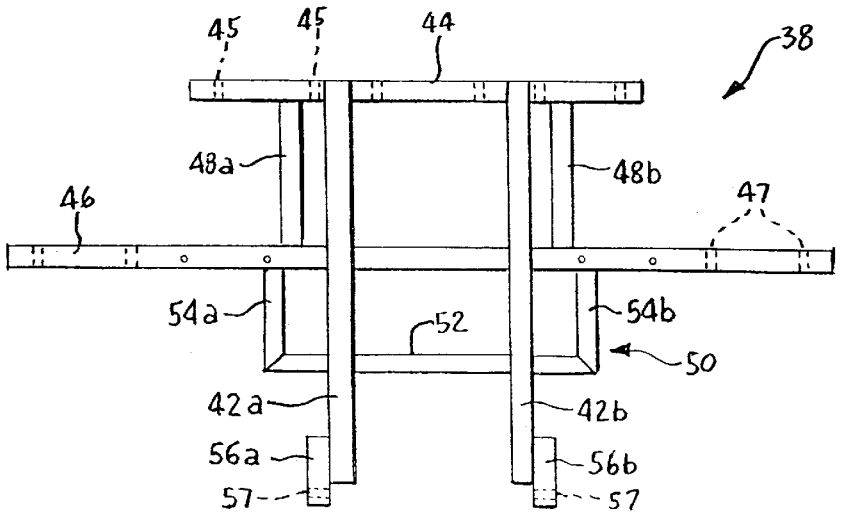
FIG. 7 is a front view of a front frame assembly used with the motorized picnic table.
Figure 9:
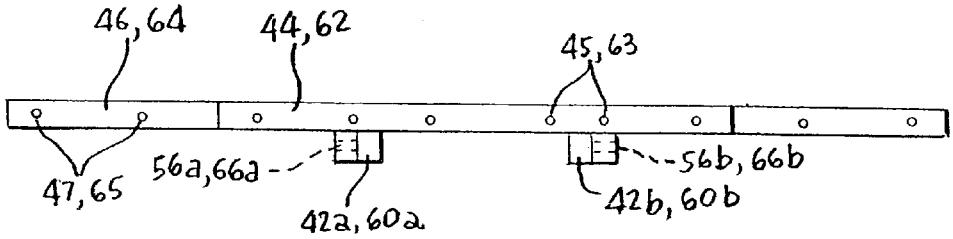
FIG. 9 is a top view coinciding with both front and rear frame assemblies.
Figure 8:
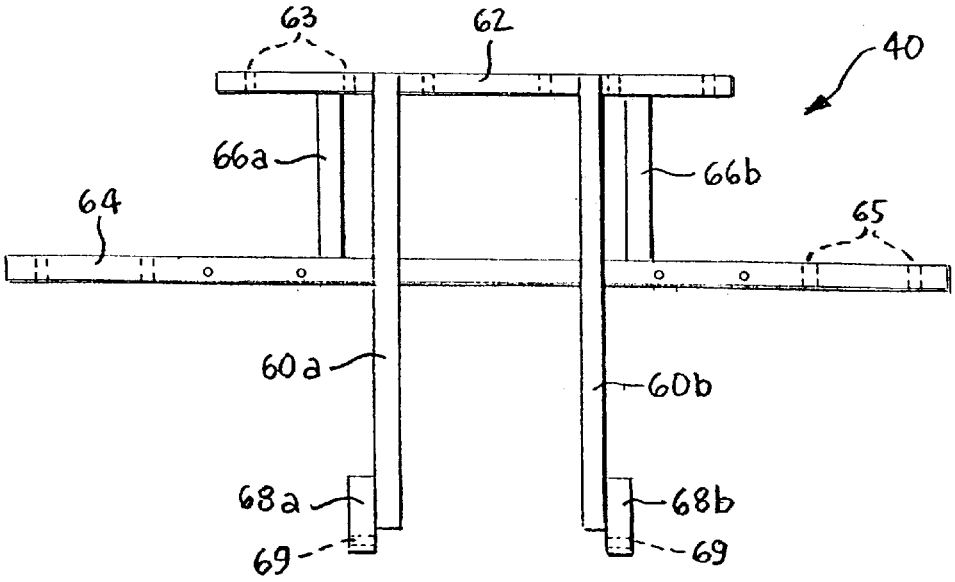
FIG. 8 is a rear view of a rear frame assembly used with the motorized picnic table.

Table top 12 and bench seats 14, 16 are supported by a front frame assembly generally indicated as 38 (FIG. 7) and a rear frame assembly generally indicated as 40 (FIG. 8). The front frame assembly 38 is fabricated from 1.5 inch square, 11 gauge steel tubing. Front frame assembly 38 includes a pair of main vertical supports 42*a*, 42*b*, said vertical supports being substantially parallel to one another. Mounted perpendicular to main vertical supports 42*a*, 42*b* is a front table top support 44 having vertical bores 45 and a seat support 46 having vertical bores 47. To increase the structural stability of the front frame assembly 38, a pair of supplemental vertical supports 48*a*, 48*b* are mounted between table top support 44 and seat support 46. Supplemental vertical supports 48*a*, 48*b* are attached in closes proximity to main vertical supports 42*a*, 42*b* respectively, and are oriented substantially parallel thereto. Additional structural support for front frame assembly 38 is also provided by a lower support generally indicated by 50 consisting of a horizontal member 52 and a pair of vertical members 54*a*, 54*b*. Horizontal member 52 is attached and mounted perpendicularly to main vertical support members 42*a*, 42*b* with distal ends of horizontal member 52 extending beyond main vertical supports 42*a*, 42*b*. Vertical member 54*a* is mounted between seat support 46 and one distal end of horizontal member 52, while vertical member 54*b* is mounted between seat support 46 and the other distal end of horizontal member 52. At the lower most portion of front frame assembly 38, a pair of front floor support members 56*a*, 56*b* are attached to main vertical supports 42*a*, 42*b* respectively. Front floor support members 56*a*, 56*b* have horizontal bores 57 located in a portion of the floor support members, which is below main vertical supports 42*a*, 42*b*.

Referring to FIG. 8, rear frame assembly 40, like front frame assembly 38, has a pair of parallel main vertical supports 60*a*, 60*b*. Mounted perpendicularly at the top of main vertical supports 60*a*, 60*b* is a rear table top support 62 having vertical bores 63. A rear seat support 64 having vertical bores 65 is mounted approximately midway on main vertical supports 60*a*, 60*b*. Mounted parallel and in close proximity to rear main vertical supports 60*a*, 60*b*, are rear supplemental vertical supports 66*a*, 66*b* respectively. As with front frame assembly 38, rear frame assembly 40 also has a pair of rear floor support members 68*a*, 68*b* attached at the lower end of main vertical supports 60*a*, 60*b* respectively. Horizontal bores 69 extend through rear floor support member 68*a*, 68*b* at a location beneath the lower end of main vertical support 60*a*, 60*b*. Rear frame assembly 40 does not include a lower support similar to lower support 50 of front frame assembly 38.

Figure 5:
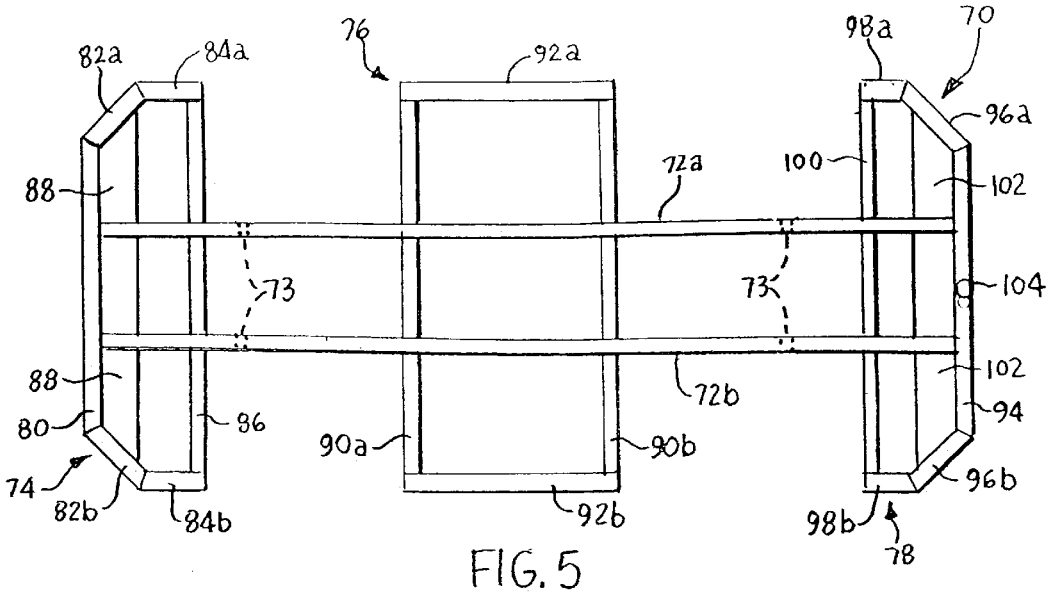
FIG. 5 is a top view of a lower floor frame used in the motorized picnic table.
Figure 6:
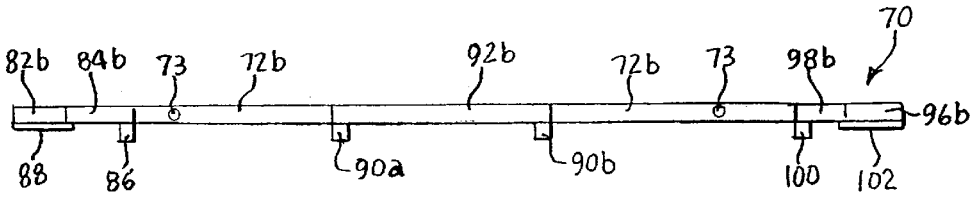
FIG. 6 is a side view of the lower floor frame.

Now referring to FIGS. 5 and 6, a floor frame assembly is generally indicated as 70. Floor frame assembly 70 provides the structural support for flooring 20. As with front frame assembly 28 and rear frame assembly 40, floor frame assembly 70 is also fabricated from 1.5 inch square 11 gauge steel tubing. Floor frame assembly 70 includes a pair of longitudinal and substantially parallel members 72*a*, 72*b*. The longitudinal members 72*a*, 72*b* have horizontal bores 73 for mounting floor frame assembly 70 to the motorized picnic table 10. Attached to longitudinal member 72*a*, 72*b* are front sections 74, a middle section 76, and a rear section 78.

Front section 74 includes a transverse front member 80 at the foremost front of the frame being attached to and substantially perpendicular to longitudinal members 72*a*, 72*b*. Front section 74 also includes a pair of front angled members 82*a*, 82*b*, a pair of front side members 84*a*, 84*b*, and a front cross member 86 which is substantially parallel to transverse member 80 and perpendicular to longitudinal members 72*a*, 72*b*. Attached to the underside of front section 74 is a pair of front flooring support plates 88*a*, 88*b*.

Middle section 76 includes a pair of transverse middle members 90*a*, 90*b*, attached to and substantially perpendicular to longitudinal members 72*a*, 72*b*. Transverse middle members 90*a*, 90*b* are substantially parallel to one another. Attached and perpendicular to the distal ends of transverse middle members 90*a*, 90*b* is a pair of middle side members 92*a*, 92*b*.

Rear section 78 is similar to front section 74 and includes a transverse rear member 94 mounted substantially perpendicular to longitudinal member 72*a*, 72*b*; a pair of rear angled members 96*a*, 96*b* attached to and extending in an angle from the distal ends of transverse rear member 94; a pair of rear side members 98*a*, 98*b* attached to the rear angled members and being substantially parallel to longitudinal members 72*a*, 72*b*; and a rear cross member 100. Rear cross member 100 is mounted at ends of rear side members 98*a*, 98*b* and extends therebetween, and is also attached to longitudinal members 72*a*, 72*b* being perpendicular thereto.

On the underside of front section 70, a pair of rear flooring support plates 102*a*, 102*b* is attached thereto. Rear section 78 also includes a vertical bore 104 extending through transverse rear member 94 for use in towing a trailer, wagon, cooking grill, non-motorized picnic table or other vehicle behind the motorized picnic table.

Attached to the floor frame assembly 70 are a pair of front fenders 93 and a pair of rear fenders 95 covering front wheels 23 and rear wheels 25, respectively. The fenders are fabricated from 16 gauge galvanized sheet steel and front fender 93 and rear fender 95 each have a rolled portion 93*a*, 95*a*, respectively, covering the upper circumferential portion of each respective wheel. The sides of the fenders consist of flat skirt portions 93*b* covering the sides of front wheels 23 and 95*b* covering the sides of rear wheels 25.

Figure 10:
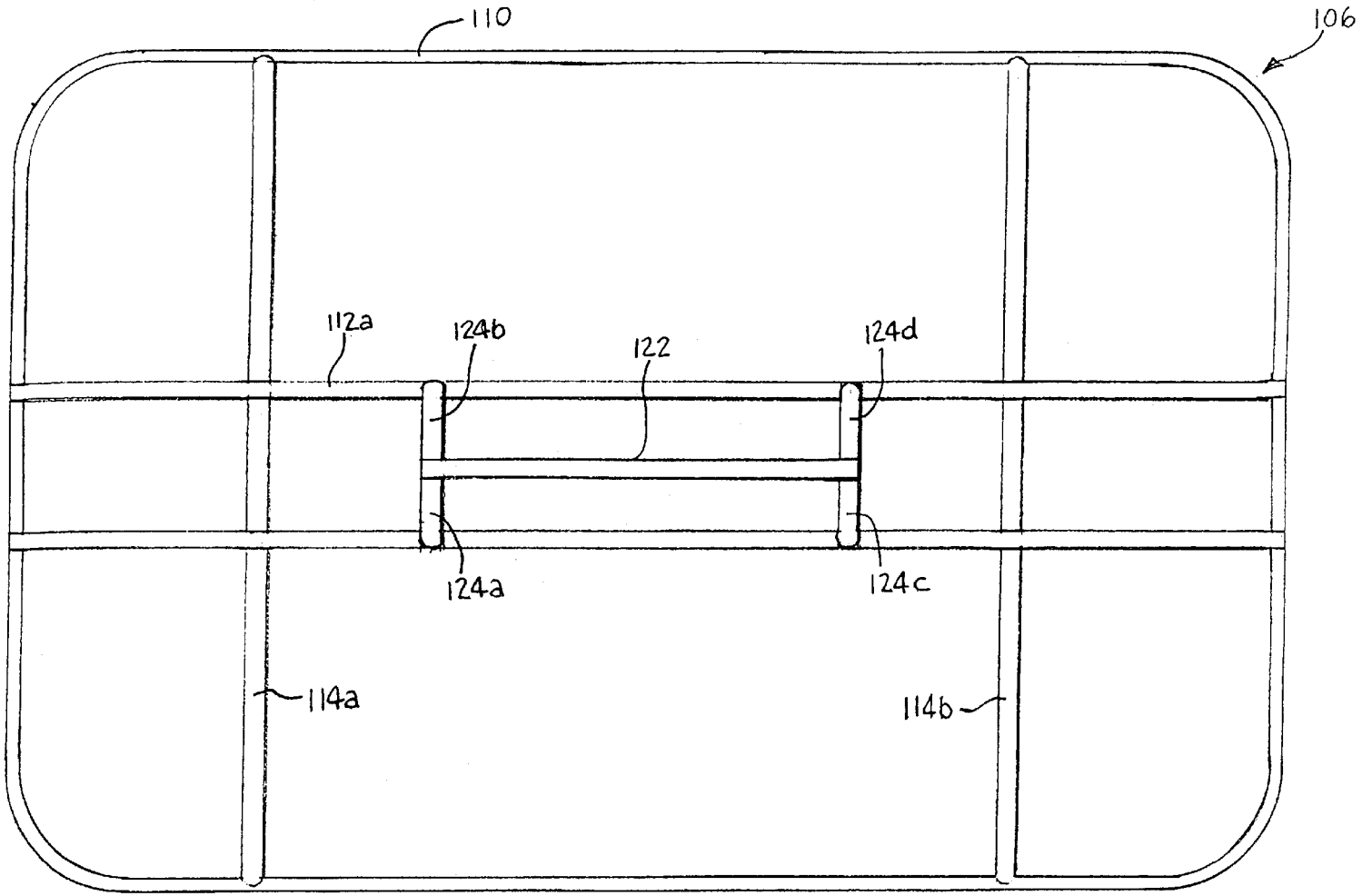
FIG. 10 is a top view of a canopy frame.
Figure 11:
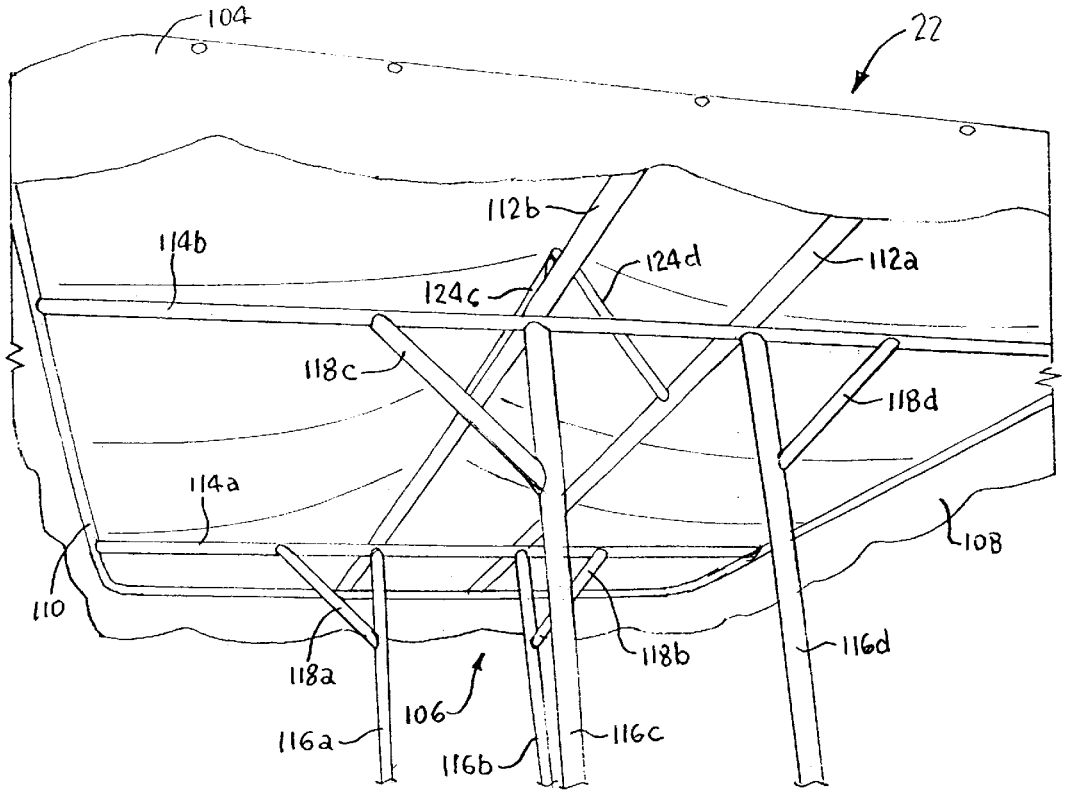
FIG. 11 is a perspective view of the canopy frame as viewed from underneath the canopy.
Figure 12:
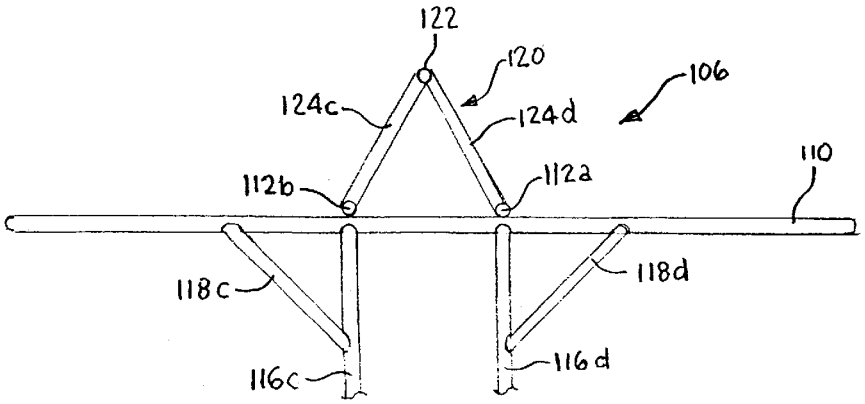
FIG. 12 is an end view of the end of the canopy frame.

As best shown in FIGS. 10–11, removable canopy 22 includes a canopy covering 104 and a canopy frame generally indicated as 106. In the preferred embodiment, canopy covering 104 consists of a woven 100% polyester fabric. Of course, other materials such as canvas, nylon, or plastic may also be used. For aesthetic looks and moisture disbursement, a valance 108 is provided around the periphery of 104.

Canopy frame 106 is constructed with 1 inch diameter circular steel tubing. Canopy frame 106 includes a peripheral member 110 which is formed in a generally rectangular shape having rounded corners. In the preferred embodiment, the periphery of the frame is ninety-eight inches long by sixty-four inches wide, and each of the corners is rounded with a ten inch radius bend. Supporting peripheral member 110 is a pair of midspan runners 112*a*, 112*b* extending the length of the canopy frame with the ends of midspan runners 112*a*, 112*b* attached to peripheral member 110. A pair of cross runners 114*a*, 114*b* extend across the width of canopy frame 106 and are also attached at respective ends to peripheral member 110 as well as being attached to midspan runners 112*a*, 112*b*. Attached to and extending downward from cross runners 114*a*, 114*b* are four vertical supports 116*a–d*. To provide structural stability to canopy frame 106, four angled supports 118*a–d* are extended between cross runners 114*a*, 114*b* and vertical supports 116*a–d* to form triangular braces.

In the preferred embodiment, canopy 22 is formed in the hip roof manner having an elevated central portion. To accomplish this, a truss generally indicated as 120 is attached to midspan runners 112*a*, 112*b*. Truss 120 is made from the same one inch diameter circular steel tubing as is the rest of canopy frame 106, and is approximately thirty-four inches long and provides ten inches of vertical lift above peripheral member 110. Truss 120 includes a longitudinal truss member 122 and four angled truss members 124*a–d* connected to midspan runners 112*a*, 112*b* and supporting longitudinal truss member 122. set forth the components above, it will now be discussed how the above parts and sub-assemblies are manufactured and assembled into the motorized picnic table. Front frame assembly 38, rear frame assembly 40, and floor frame assembly 70 as indicated above are all constructed from 1.5 inch square 11 gauge steel tubing. The frame assemblies are fabricated by cutting the tubing to length with a saw, shear or torch and then welding the pieces into the configurations disclosed using standard welding practices which are well known in the art. After front frame assembly 38 and rear frame assembly 40 are completed, each is welded to the standard chassis frame 23 (FIG. 3) of the Cub Cadet, Model 129. Front frame assembly 38 is welded to chassis frame 23 towards the lower end of main vertical supports 42*a*, 42*b* below lower support 50. Similarly, rear frame assembly 40 is welded to chassis frame 23 towards the lower ends of main vertical support 60*a*, 60*b*. Frame assemblies 38 and 40 are attached to the chassis frame 23 so that they are separated by approximately 54 inches. In the preferred embodiment, both the front and rear seat supports 46, 64 have a sixty-six inch length, while front and rear table top supports 44, 62 are approximately 34 inch in length.

SYP planks 12*a–c* are secured to front and rear table top supports 44 and 62 of front frame assembly 38 and rear frame assembly 40, respectively, using carriage bolts (not shown) and nuts (not shown). The planks 12*a–c* are centered over the fifty-four inch span between the table top supports 38 and 40, and the carriage bolts are inserted through mounting holes (not shown) in the planks and then through vertical bores 45 and 63 in front and rear table top supports 44 and 62, respectively. The carriage bolts are secured with the nuts. In a similar manner, bench seat planks 14 and 16 are secured front and rear seat supports 46 and 64 respectively using carriage bolts (not shown) and nuts (not shown). The carriage bolts are inserted through mounting holes (not shown) in planks 14 and 16 and vertical bores 47 and 65 in front and rear seat supports 46 and 64, respectively.

The floor frame assembly 70 is assembled to motorized picnic table 10 from underneath the Cub Cadet tractor chassis. Either the chassis may be elevated and the floor frame raised from beneath or the chassis may be driven over floor frame assembly 70 so that the front wheels 24 are between front section 74 and middle section 76, and the rear wheels 25 are located between middle section 76 and rear section 78. Next, four 0.4375 inch diameter bolts (not shown) are used to secure the floor frame assembly to front and rear frame assemblies 38 and 40. One bolt is inserted through each of the front horizontal bores 73 in longitudinal members 72*a* and 72*b* and then through the horizontal bores 57 in front floor support members 56*a* and 56*b*, respectively. The bolts are secured with nuts (not shown). Likewise, one 0.4375 inch bolt is inserted through each of the rear horizontal bores 73 in longitudinal members 72*a* and 72*b* and then through horizontal bores 69 in rear floor support members 68*a* and 68*b*, respectively. Again, the bolts are secured with nuts (not shown). In the preferred embodiment, the floor frame assembly is elevated about six inches off of the ground. The reason the floor frame assembly is bolted to the motorized picnic table instead of welding or other permanent attachment means is to allow easy removal of the floor frame for maintenance on the chassis.

The rolled fender portions 93*a* and 95*a* are rolled to shape and then bolted to the floor frame assembly. The front rolled fender portions 93*a* are attached to front cross member 86 and transverse middle member 90*a*, while rear rolled fender portions are attached to transverse middle member 90*b* and rear cross member 100. Flat skirt portions 93*b* and 95*b* are then attached to rolled portions 93*a* and 95*a*, respectfully, using clips, brackets, bolts, or by welding.

To complete flooring 20, a 1.5 inch thick SYP footrests (not shown) are inserted into the floor frame assembly 70. The SYP footrests are cut to size and bolted with carriage bolts (not shown) and nuts (not shown). In front section 74 the SYP footrests are bolted to the front flooring support plate 88 and front cross member 86 so that the top of the SYP footrest is flush with the top of the floor frame assembly. Three footrest sections are used in each of front section 74 and rear section 76 with one footrest section to the outside of longitudinal member 72*a*, one footrest section to the outside of longitudinal member 72*b*, and one footrest section between the longitudinal members in both the front and rear. In rear section 78 the footrest sections are bolted to rear flooring support plate 102 and rear cross member 100. In middle section 76 only two footrest sections are used, one outside of longitudinal member 72*a* and one outside longitudinal member 72*b*. The middle section footrests are bolted to transverse middle members 90*a* and 90*b*. A footrest is not required in between longitudinal members 72*a* and 72*b* in the middle section 76 as the Cub Cadet chassis is located directly above this area. All footrest sections are mounted flush with the top of the floor frame assembly. To enhance the appearance and preserve the wood, all SYP planks and footrests are stained and varnished.

As with the front and rear frame assembly, the canopy frame 106 is fabricated by cutting and welding the one inch diameter steel tube sections. The canopy frame is attached by inserting one of each of the vertical supports 116*a–d* into the corresponding canopy mounting aperture 17 in table 12 and then into the corresponding front or rear main vertical support 42*a*, 52*b*, 60*a*, or 62*b*, said main vertical supports being located directly beneath and aligned with the canopy mounting apertures 17. The canopy vertical supports 116*a–d* may be secured to main vertical supports 42*a*, 42*b*, 60*a*, or 60*b* by drilling a hole and securing with a bolt or pin so that the canopy is approximately thirty inches above the table top. The canopy covering 104 is fabricated by cutting and/or sewing material to size including the valance 108 which is scalloped and extends down from the periphery of the canopy 22 a distance of about six inches. Stainless steel snaps (not shown) or other fasteners are provided in canopy covering 104 to removably attach the covering to the canopy frame. The canopy covering 104 is removable for cleaning, repair or storage purposes.

In operation, the motorized picnic table 10 as described comfortably seats and transports eight picnickers. The flooring 20 and fenders 93, 95 provide sufficient space and protection from moving parts for all eight occupants' feet. A driver is seated on bench seat 16 adjacent steering wheel 34 and can fully operate the picnic table 10 from this position including a starting/stopping switch (not shown), an engine throttle control (not shown), a brake pedal (not shown), a head light switch (not shown), a canopy light switch (not shown), a horn (not shown), and the hydrostatic transmission control lever 21. It has been found to be convenient to mount the starting switch, horn, and light switches on a control panel on the underside of table 12.

The engine 19 provides rotary input to the hydrostatic transmission through the direct coupled drive shaft. The variable speed reversible rotary output of the hydrostatic transmission drives the rear wheels 25 through a gear reduction and differential located within the transaxle housing. The hydrostatic transmission allows for a high degree of speed control and braking regardless of the load or number of occupants on picnic table 10 or the terrain in which it is operated.

The transmission control lever 21 and associated linkage allows the driver to variably control the speed of picnic table 10 in both the forward and reverse directions. Moving he control lever 21 forward from a neutral position, moves the picnic table 10 forward, and the further the control lever is moved forward the faster picnic table 10 will move. On the other hand, moving the control lever backwards from the neutral position will move picnic table 10 in the reverse direction. As the lever is moved closer to the neutral position from either the forward or reverse positions, the picnic table 10 will slow and come to a stop.

A number of operational safety features are built into the motorized picnic table 10. Some features come standard with the Cub Cadet model 129, for instance the brake pedal must be depressed and the hydrostatic transmission must be in neutral to start the engine. Other safety features have been added such as a mercury level sensing switch (not shown) in order to shut the engine off if the picnic table 10 is driven onto terrain having an angle of inclination beyond the safe operating degree of slope. Also, a self-centering damper mechanism (not shown) can be added in the linkage between the transmission control lever 21 and the transmission. The damper mechanism will automatically stop forward or reverse movement of the picnic table 10 when the control lever 21 is released by biasing it to the neutral position. A suitable dampening mechanism is available as model #SCD12 from the H. A. Guden Company. The rating of this model is rate limited so as to provide sufficient dampening force to bias the control lever 21 to the neutral position. Yet, the transition is slow enough so that it will not jerk the occupants if the control lever is suddenly released.

The canopy 22 of the picnic table provides a sun shield for the occupants as well as providing protection against rain. In the preferred embodiment, the sides of the picnic table 10 are open, but of course side shields may be provided. Also, the canopy 22 may be removed if desired.

It has also been found that the use, safety, enjoyment and aesthetic appearance of the picnic table may be enhanced by providing additional accessories. For instance, a pair of 12 volt DC head lights (not shown) may be mounted beneath the table 12 facing in the forward direction so that the picnic table can be driven at night. Also, 12 volt DC clearance lights (not shown) may be mounted beneath bench seats 14, 16 to provide night time visibility of the picnic table from the sides and rear. Lights may also be mounted to the canopy frame to illuminate the table top. Amber 12 volt DC lights (not shown) provide a soft and pleasant atmosphere. As discussed, all light switches may be provided on a control panel mounted beneath table 12 in the vicinity of the driver. It has also been found to be convenient to attach a beverage cooler (not shown) in the middle of front section 74 and a refuse container (not shown) to the middle of the rear section 78.

Although the invention described above has been taught with the preferred embodiment, it will be apparent to one skilled in the art that numerous alternatives may be utilized without departing from the spirit and scope of the invention. For example, any suitable drive engine or chassis may be substituted for the Cub Cadet model 129 including a 2 cycle engine, an electric motor or even a solar powered unit. Solar power collector cells could be mounted on the canopy 22. It would also be possible to use a pedal and chain drive system.

In addition, other transmissions may be substituted for the hydrostatic transmission. For instance, a standard transmission or single speed transmission may be used. Also, a single bench seat or more than two seats may be substituted. Stools, regular chair seats, or bicycle chair seats may also be substituted for the bench seats. Other table shapes may be used such as round, pentagonal, or other geometric shapes instead of the traditional style picnic table arrangement. The table top may also be made from a single piece plank or as many planks as desired. Furthermore, other materials may be substituted for the SYP planks such as other woods, metals, fiberglass, or plastic.

While the invention has been taught with specific reference to the above described features, someone skilled in the art will recognize that other changes can be made in form and detail without departing from the spirit and scope of the invention. The described embodiments are to be considered in all respects only as illustrative and not restrictive. The scope of the invention is, therefore, indicated by the following claims rather than be description. All changes that come within the meaning and range of equivalency of the claims are to be embraced within the scope.

What is claimed is:

1. A motorized table for use as a mobile picnic surface comprising a chassis including a frame, wheels, and a drive mechanism having an engine; a table located overtop said engine and mounted to said chassis; a bench seat mounted adjacent said table and carried by said chassis, said seat attached to the chassis at a height convenient for the operator to use the table; and a steering mechanism for sterring said chassis, said steering mechanism capable of being driven by an operator seated at said seat.

2. The motorized table as set forth in claim 1, further comprising a second bench seat mounted on a side of said table opposite to and at the same height of said first seat.

3. The motorized table as set forth in claim 2, wherein the drive mechanism is located beneath said table top and between said seats.

4. The motorized table as set forth in claim 1, further comprising a roof and a roof mounting frame for supporting said roof above said table.

5. The motorized table as set forth in claim 4, wherein said roof mounting frame extends through apertures in said table for mounting to said chassis.

6. The motorized table as set forth in claim 1, wherein the drive mechanism includes a hydrostatic transmission.

7. The motorized table as set forth in claim 6, wherein the hydrostatic transmission has an operating lever and a biasing mechanism for biasing said operating lever into a neutral position when not actively engaged.

8. The motorized table as set forth in claim 1, further comprising wheel fenders, said wheel fenders extending over at least a portion of sides of said wheels to protect feet and legs of users of the motorized table from said wheels when turning.

9. The motorized table as set forth in claim 1, further comprising a foot platform for users of the table to rest their feet upon.

10. A motorized table for use as a mobile picnic surface comprising a chassis including a frame, wheels, and a drive mechanism having an engine; a table located overtop said engine and mounted to said chassis; a seat mounted adjacent said table and carried by said chassis; and a steering mechanism extending through a steering aperture in said table for steering said chassis, said steering mechanism capable of being driven by an operator seated at said seat.

11. A motorized picnic table comprising a drive mechanism having an engine, wheels connected to and driven by said engine, a table mounted above said drive mechanism, and a pair of seats flanking said engine on opposite sides thereof, wherein the seats are bench-type seats, and said seats extend in a longitudinal direction along the length of said motorized picnic table.

12. The motorized picnic table as set forth in claim 11, including fenders covering at least a portion of said wheels to protect feet and legs of users of the table from wheels when in motion and a foot platform for users to rest their feet upon.

13. The motorized picnic table as set forth in claim 11, further comprising a roof and a roof mounting frame for mounting said roof above said table.

14. The motorized picnic table as set forth in claim 11, having open sides.

15. The motorized picnic table as set forth in claim 11, including a steering mechanism wherein said steering mechanism being operable by an operator seated on one of said seats.

16. The motorized picnic table as set forth in claim 15, wherein said steering mechanism extends through an aperture in said picnic table.

17. The motorized picnic table as set forth in claim 11, wherein said drive mechanism includes a hydrostatic transmission.

18. The motorized picnic table as set forth in claim 17, wherein said hydrostatic transmission has an operating control and a biasing mechanism for biasing the operator control in the neutral position when not being activated.

19. The motorized picnic table as set forth in claim 17, including a chassis frame and a front and rear frame assembly attached to said chassis frame for supporting a table and seats.

20. The motorized picnic table as set forth in claim 19, further comprising a foot platform for users to rest their feet upon, said foot platform attached to and supported by said front and rear frame assemblies.

21. A motorized vehicle comprising a drive mechanism, front and rear wheels connected to and driven by said drive mechanism, a table mounted above said drive mechanism and extending for substantially the length of the vehicle, said length being defined along the primary direction of travel of said vehicle, a seat mounted adjacent said table for use by an operator of said vehicle, and a second seat, wherein said seats are flanked on opposite sides of said drive mechanism and extend along the length of the vehicle.

22. The vehicle as set forth in claim 21, wherein a plurality of users may be seated at said seat facing said table while said vehicle is in motion.

23. A motorized vehicle comprising a drive mechanism, front and rear wheels connected to and driven by said drive mechanism, a table mounted above said drive mechanism and extending for substantially the length of the vehicle, said length being defined along the primary direction of travel of said vehicle, a seat mounted adjacent said table for use by an operator of said vehicle, a front frame assembly and a rear frame assembly for supporting said table, and a floor frame assembly, said floor frame assembly connected to and suspended by said front and rear frame assemblies, as said table and said frame assemblies are positioned for use as a picnic table, said floor frame assembly including longitudinal members and front, middle and rear sections mounted to said longitudinal members, wherein the front wheels of the vehicle are located between the front and middle sections, and the rear wheels are located between the middle and rear sections.

24. The vehicle as set forth in claim 23, wherein the seat is mounted to and supported by said front and rear frame assemblies.

* * * * *

UNITED STATES PATENT AND TRADEMARK OFFICE

CERTIFICATE OF CORRECTION

PATENT NO. : 6,637,349 B1
DATED : October 28, 2003
INVENTOR(S) : Gregory A. Lafferty It is certified that error appears in the above-identified patent and that said Letters Patent is hereby corrected as shown below:

Column 9,
Line 13, delete “sterring” and insert -- steering --

Signed and Sealed this

Second Day of March, 2004

JON W. DUDAS
*Acting Director of the United States Patent and Trademark Office*